US010799078B1

(12) United States Patent
Howard

(10) Patent No.: US 10,799,078 B1
(45) Date of Patent: Oct. 13, 2020

(54) URINAL APPARATUS

(71) Applicant: Archie Howard, Springfield, PA (US)

(72) Inventor: Archie Howard, Springfield, PA (US)

( * ) Notice: Subject to any disclaimer, the term of this patent is extended or adjusted under 35 U.S.C. 154(b) by 0 days.

(21) Appl. No.: 16/280,146

(22) Filed: Feb. 20, 2019

(51) Int. Cl.
*A47K 11/12* (2006.01)

(52) U.S. Cl.
CPC ..... *A47K 11/12* (2013.01)

(58) Field of Classification Search
CPC ..... A47K 11/12
USPC ..... 4/44.1–144.3
See application file for complete search history.

(56) References Cited

U.S. PATENT DOCUMENTS 3,343,542 A * 9/1967 Ericson ..... A61F 5/4405 604/325
3,346,883 A * 10/1967 Ersek ..... A61B 10/0045 4/661
3,650,272 A * 3/1972 Ericson ..... A61F 5/44 604/325
3,742,523 A * 7/1973 Atkins ..... A61F 5/44 4/144.2
4,857,064 A * 8/1989 Mendoza ..... A61F 5/44 604/347
5,065,459 A * 11/1991 Tjahaja ..... A61F 5/44 4/144.2
5,643,236 A * 7/1997 Hadley ..... A61F 5/4408 604/353
5,852,830 A * 12/1998 Horn ..... A47K 11/12 4/144.1
6,070,275 A * 6/2000 Garlock ..... A47K 11/12 4/144.1
6,460,200 B1 * 10/2002 Mottale ..... A61F 5/4556 141/331
7,131,149 B2 * 11/2006 Langford ..... A61F 5/4556 4/144.4
7,255,477 B2 * 8/2007 Arnell ..... B65D 33/2591 383/61.2
8,066,657 B2 * 11/2011 Frazer ..... A61F 13/148 128/95.1
8,146,179 B1 * 4/2012 Duque ..... A61F 5/4556 4/144.1
8,181,284 B1 5/2012 Parker
8,361,044 B2 * 1/2013 Marshall ..... A61F 5/449 224/148.1
8,388,585 B2 * 3/2013 Tomes ..... A61F 13/15 604/329
D684,260 S * 6/2013 Lund ..... D24/118
8,608,718 B1 * 12/2013 Patterson-Young ..... A61F 5/4408 604/345
9,078,760 B2 * 7/2015 Marshall ..... A61F 5/44
(Continued)

*Primary Examiner* — Lori L Baker
(74) *Attorney, Agent, or Firm* — Sanchelima & Associates, P.A.; Christian Sanchelima; Jesus Sanchelima

(57) ABSTRACT

A urinal apparatus is mounted in an automobile. The urinal apparatus comprises a base sheet and a handle coupled to the base sheet. Further, the urinal apparatus comprises a first sheet coupled to the base sheet to form a first container having a first opening. The urinal apparatus comprises a second sheet coupled to the base sheet to form a second container having a second opening. The urinal apparatus comprises at least one bladder placed in the first container. The handle is used to couple the urinal apparatus to the automobile e.g., to a door handle. The bladder is used to urinate while the automobile is on the move and the bladder is placed in the second container after use for later disposal.

9 Claims, 3 Drawing Sheets

(56) References Cited

U.S. PATENT DOCUMENTS

| | | | | |
|---|---|---|---|---|
| D761,955 | S * | 7/2016 | Marshall | D24/118 |
| 9,592,170 | B2 * | 3/2017 | Cailleteau | B65D 33/16 |
| D866,881 | S * | 11/2019 | Hathaway | D30/162 |
| 2012/0210503 | A1 | 8/2012 | Anzivino, Sr. | |
| 2016/0113809 | A1 * | 4/2016 | Kim | A61G 5/1002 604/353 |

* cited by examiner

URINAL APPARATUS

BACKGROUND OF THE INVENTION

1. Field of the Invention

The present invention generally relates to a urinal apparatus. More specifically, the present invention relates to a urinal apparatus for use in an automobile.

2. Description of the Related Art

It is known that motorists and passengers alike find it necessary to relieve themselves of urine when traveling. However, it is inconvenient to relieve urine while travelling on a highway. Typically, the motorists and/or passengers may use public or private restrooms while travelling on the highway to relieve of the urine. In case non-availability of restrooms and/or due to unavoidable circumstances, they perform their bodily functions on the sides of roads or in empty containers that end up discarded on the roadside. However, reliving on the sides of the road or discarding of the used containers on the sides of the road is not sanitary or acceptable solution.

The above problem is particularly applicable for drivers of automobiles such as trucks, the drivers who typically drive for long distances. Further, the above problem aggravates for those suffering from incontinence, weak bladders or frequent urination.

In order to overcome above problems, several portable urinal apparatuses have been disclosed in the past. One such example is disclosed in a United States Granted patent U.S. Pat. No. 5,852,830A. In U.S. Pat. No. 5,852,830A, a portable urinal device is provided including a flexible collapsible bag having a top face. At least one perforation is formed in the top face of the bag for allowing a user to urinate in the bag. Next provided is a pair of lips integrally coupled to side edges of the top face of the bag and extended upwardly therefrom. The lips have a coupling mechanism thereon for allowing a user to selectively preclude access to the top face and further prevent the leaking of urine from the slits.

Another example is disclosed in a United States Granted patent U.S. Pat. No. 5,848,443A. In U.S. Pat. No. 5,848,443A, an automobile urinal having a portable elevated flushing solution container, a portable bowl, (which when in use is positioned in the seat) and a portable disposable collecting bladder is disclosed. The flushing solution container and the disposable collecting bladder are separately connected to the bowl by valved tubing.

Another example is disclosed in a United States Granted patent U.S. Pat. No. 8,181,284B1. In U.S. Pat. No. 8,181,284B1, a mobile sanitary urinal apparatus for truck drivers or others who do not have access to restroom facilities while traveling comprising a removable accumulation vessel mounted to interior or exterior of a motor vehicle is disclosed. The urinal is designed to be discretely used in the passenger compartment of tractor-trailer rigs, although it can be used discretely in almost any vehicle. It comprises a catheter-type receiver, which attaches to plumbing thereby functioning as a urinal to receive urine from a user and directing it through the hose to a retention container. It is envisioned that the retention container would be emptied into a sanitary collection station or normal restroom when feasible. The urinal can be cleaned periodically using a provided sanitation kit with a flushing bulb and liquid cleanser that would be flushed through the system cleaning the valves, hoses, and container.

Another example is disclosed in a United Patent application US20120210503A1. In US20120210503A1, a portable urine collection and disposal system comprising a saddle-seat, a drain tube, and a collection bottle. The saddle seat comprises a flexible material and is conformable to a male or a female user genital or gluteus maximus region to seal against the body and may be useable to collect urine from a user. The apparatus may be inconspicuous and useable while traveling in a vehicle. The saddle-seat comprises a cupped inner volume with a sloped flow channel having an egress spout, coupleable to a drain tube, and the drain tube coupleable to a collection bottle. The collection bottle may comprise a bayonet coupling which may be removable and replaceable with an aperture-less lid. The collection bottle may sealably store urine until it can be conveniently disposed of.

Other documents describing the closest subject matter provide for a number of more or less complicated features that fail to solve the problem in an efficient and economical way. None of these patents suggest the novel features of the present invention. Specifically, none of the disclosures in the art disclose a urinal apparatus comprising a case having a bladder, which a driver or a passenger of an automobile may use to urinate in the bladder and store in the case for later disposal.

Therefore, there is a need in the art for a urinal apparatus comprising a case i.e., a container having a bladder, which a driver or a passenger of an automobile can use for urination.

SUMMARY OF THE INVENTION

It is one of the main objects of the present invention to provide a urinal apparatus provided in an automobile and that avoids the drawbacks of the prior art.

It is one object of the present invention to provide a urinal apparatus comprising a container for placing a plurality of bladders. A driver or a passenger of an automobile can use the bladders for urination.

It is one object of the present invention to provide a urinal apparatus in an automobile. The urinal apparatus comprises a base sheet and a handle coupled to the base sheet. Further, the urinal apparatus comprises a first sheet coupled to the base sheet to form a first container having a first opening. The urinal apparatus comprises a second sheet coupled to the base sheet to form a second container having a second opening. The urinal apparatus comprises at least one bladder placed in the first container. The handle is used to couple the urinal apparatus to the automobile e.g., to a door handle. The bladder is used to urinate while the automobile is on the move and the bladder is placed in the second container after use for later disposal.

It is another object of the present invention to provide a urinal apparatus comprising a zipper, which is operated using a slider assembly. The urinal apparatus is used to for storing bladders, which are used for collecting urine.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

The following detailed description is intended to provide example implementations to one of ordinary skill in the art, and is not intended to limit the invention to the explicit disclosure, as one or ordinary skill in the art will understand that variations can be substituted that are within the scope of the invention as described.

The present disclosure discloses a urinal apparatus provided in an automobile. The urinal apparatus comprises a base sheet and a handle coupled to the base sheet. Further, the urinal apparatus comprises a first sheet coupled to the base sheet to form a first container having a first opening. The urinal apparatus comprises a second sheet coupled to the base sheet to form a second container having a second opening. The urinal apparatus comprises at least one bladder placed in the first container. The handle is used to couple the urinal apparatus to the automobile e.g., to a door handle. The bladder is used to urinate while the automobile is on the move and the bladder is placed in the second container after use for later disposal.

Various features and embodiments of a urinal apparatus provided in an automobile are explained in conjunction with the description of FIGS. 1-7.

Figure 1:
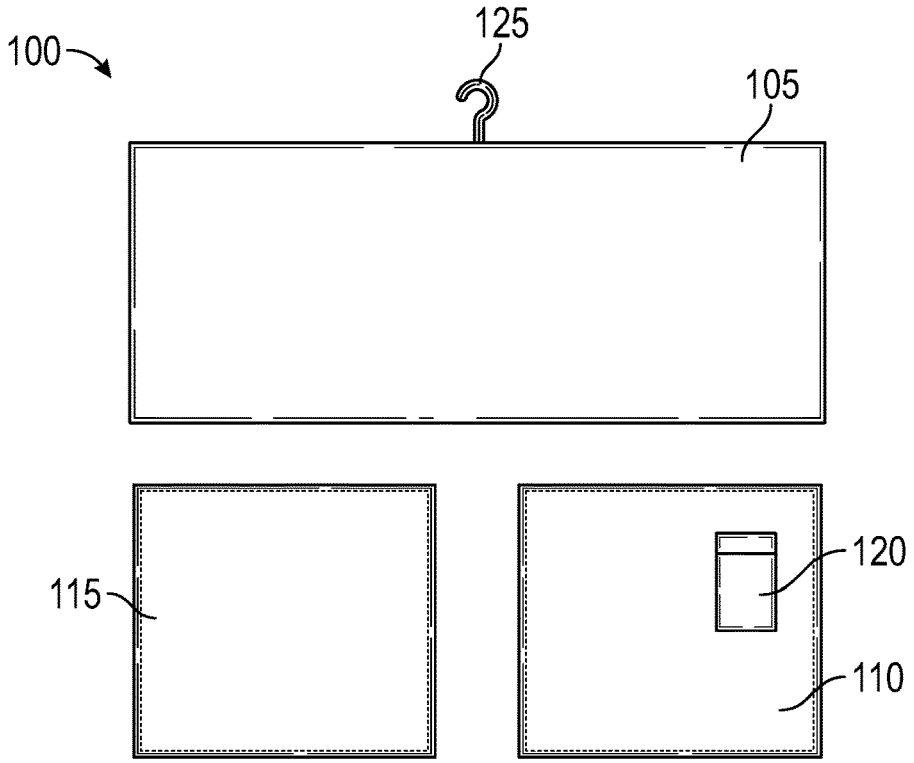
FIG. 1 illustrates an exploded view of a urinal apparatus 100, in accordance with one embodiment of the present disclosure.

Referring to FIG. 1, an exploded view of a urinal apparatus 100 is shown, in accordance with one embodiment of the present disclosure. The urinal apparatus 100 comprises a base sheet 105, a first sheet 110, and a second sheet 115. Each of the base sheet 105, the first sheet 110, and the second sheet 115 may be made up of plastic, fabric, polythene or any other suitable materials. It should be understood that the size the base sheet 105 is more than the size of the first sheet 110, and the second sheet 115. Further, the urinal apparatus 100 comprises a pocket 120 provided at the first sheet 110. Further, the urinal apparatus 100 comprises a handle 125.

Figure 2:
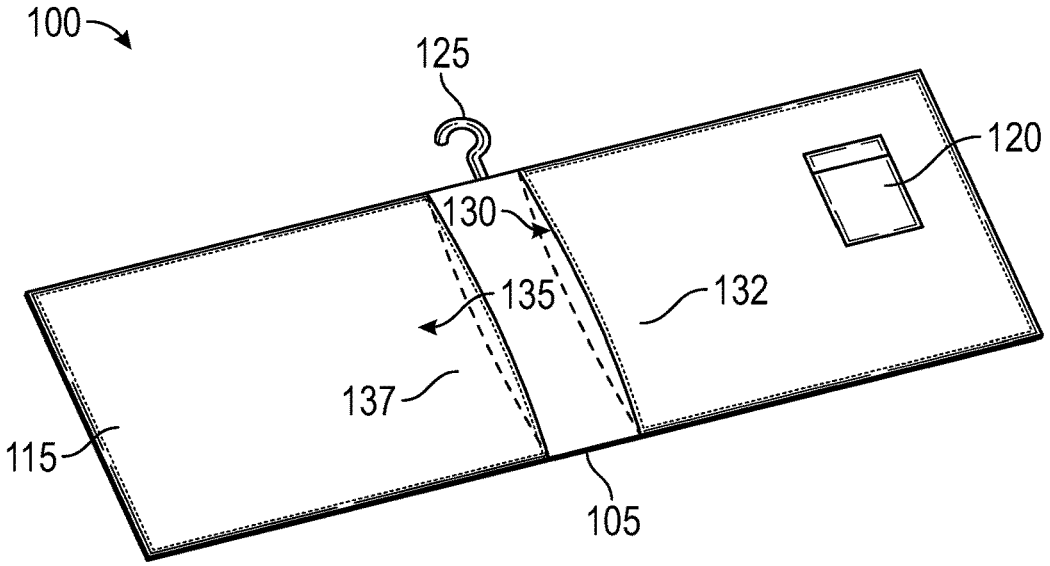
FIG. 2 illustrates a perspective view of urinal apparatus 100, in accordance with one embodiment of the present disclosure.

Now, referring to FIG. 2, a perspective view of the urinal apparatus 100 is shown, in accordance with one embodiment of the present disclosure. As can be seen, the first sheet 110 is coupled to the base sheet 105. Specifically, the first sheet 110 is coupled to the base sheet 105 at three sides to form a first container 130 with a first opening 132. The first sheet 110 may be coupled to the base sheet 105 using adhesive or seam or any other known means. It should be understood that the first opening 132 provides access to the first container 130 formed between the base sheet 105 and the first sheet 110. Further, the second sheet 115 is coupled to the base sheet 105. Specifically, the second sheet 115 is coupled to the base sheet 105 at three sides to form a second container 135 with a second opening 137. The second sheet 115 may be coupled to the base sheet 105 using adhesive or seam or any other known means. It should be understood that the second opening 132 provides access to the second container 137 formed between the base sheet 105 and the second sheet 115.

Figure 3:
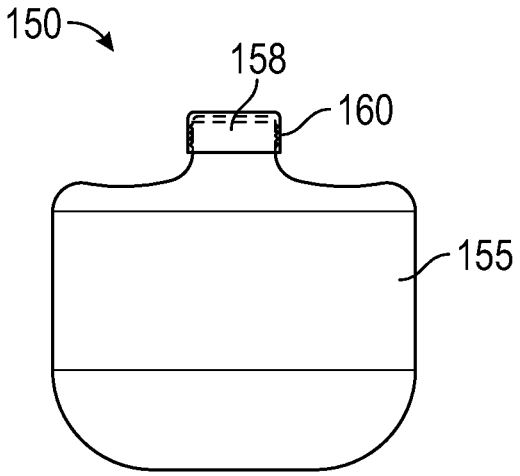
FIG. 3 illustrates a bladder 150, in accordance with one embodiment of the present disclosure.

In one implementation, the urinal apparatus 100 comprises a bladder 150 as shown in FIG. 3. The bladder 150 may comprise a body 155. The body 155 may indicate a hollow structure selected in any shape and size. Preferably, the body 155 is selected in a square or rectangular shape. In one example, the body 155 may comprise a neck 158. The neck 158 provides access to the body 155, which may be closed using a cap 160. It should be understood that the cap 160 might be removably coupled to the neck 158. The cap 160 may be coupled to the neck 158 using known mechanisms such as a snap-mechanism or a threaded mechanism.

Figure 4:
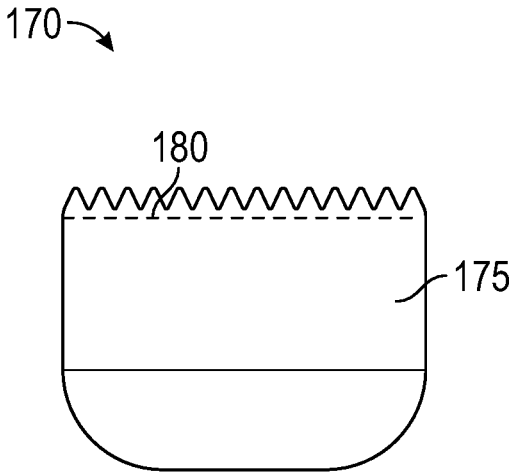
FIG. 4 illustrates a bladder 170, in accordance with one exemplary embodiment of the present disclosure.

Referring to FIG. 4, a bladder 170 is shown, in accordance with one exemplary embodiment of the present disclosure. The bladder 170 may comprise a body 175. The body 175 may be made using a sheet material. The body 175 may comprise a liner 180. In order to access interior of the body 175, the liner 180 may be torn opened.

Figure 5:
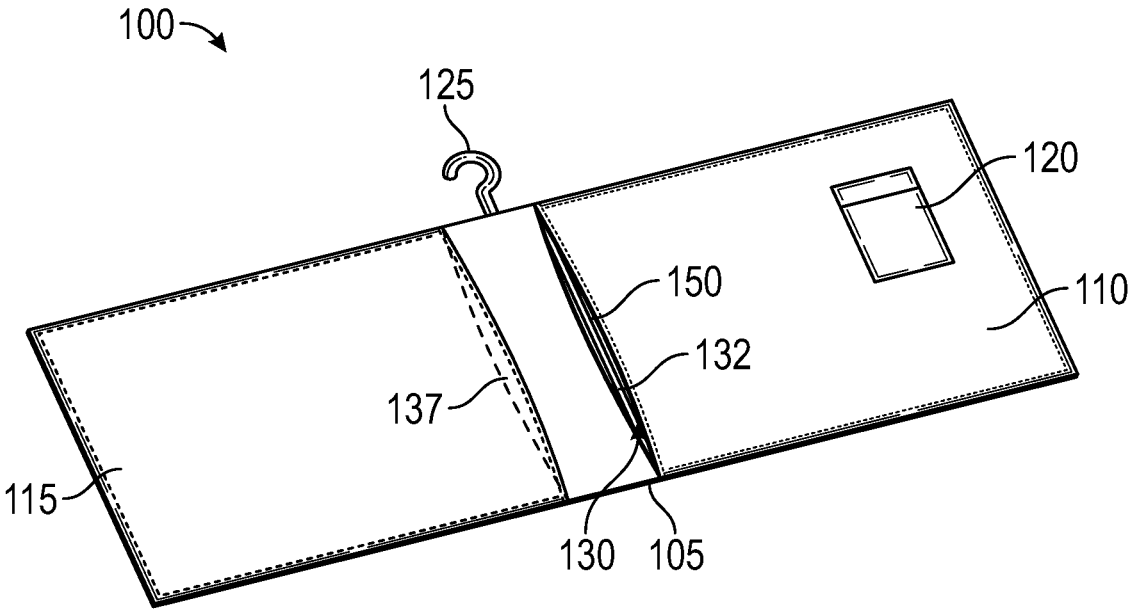
FIG. 5 illustrates the bladder 150 placed inside the urinal apparatus 100, in accordance with one embodiment of the present disclosure.

Referring to FIG. 5, the bladder 150 placed inside the urinal apparatus 100 is shown, in accordance with one embodiment of the present disclosure. It should be understood that a plurality of bladders 150 might be placed in the first container 130. Alternatively, the plurality of bladders 150 may be placed in the second container 135.

It should be understood that the urinal apparatus 100 might be used for collecting and storing urine of a user. In order to collect the urine, at first, the plurality of bladders 150 may be placed in the first container 130. When the user wishes to urinate, the user may remove the bladder 150 from the first container 130. Subsequently, the user may open the cap 160. Further, the user may urinate into the body 155 of the bladder 150. Upon completion, the user may place the cap 160 on the neck 158 and tighten the cap 160. After closing the cap 160, the user may place the bladder 150 containing urine in the second container 135.

It is to be noted that the bladders 150 that are unused are placed in the first container 130. Whenever the user wishes to urinate, the user may remove the bladder 150 from the first container 130. After urinating in the bladder 150, the user may place the bladder 150 in the second container 135. In one implementation, the urinal apparatus 100 may comprise a sanitizer (not shown). The sanitizer may be placed in the pocket 120. After urinating in the bladder 150 and placing the bladder 150 in the second container 135, the user may use sanitizer to clean his hands.

Whenever the user reaches a dispensing area suitable for disposing the bladder 150 containing the urine, the user may dispose off the bladders 150.

Figure 6:
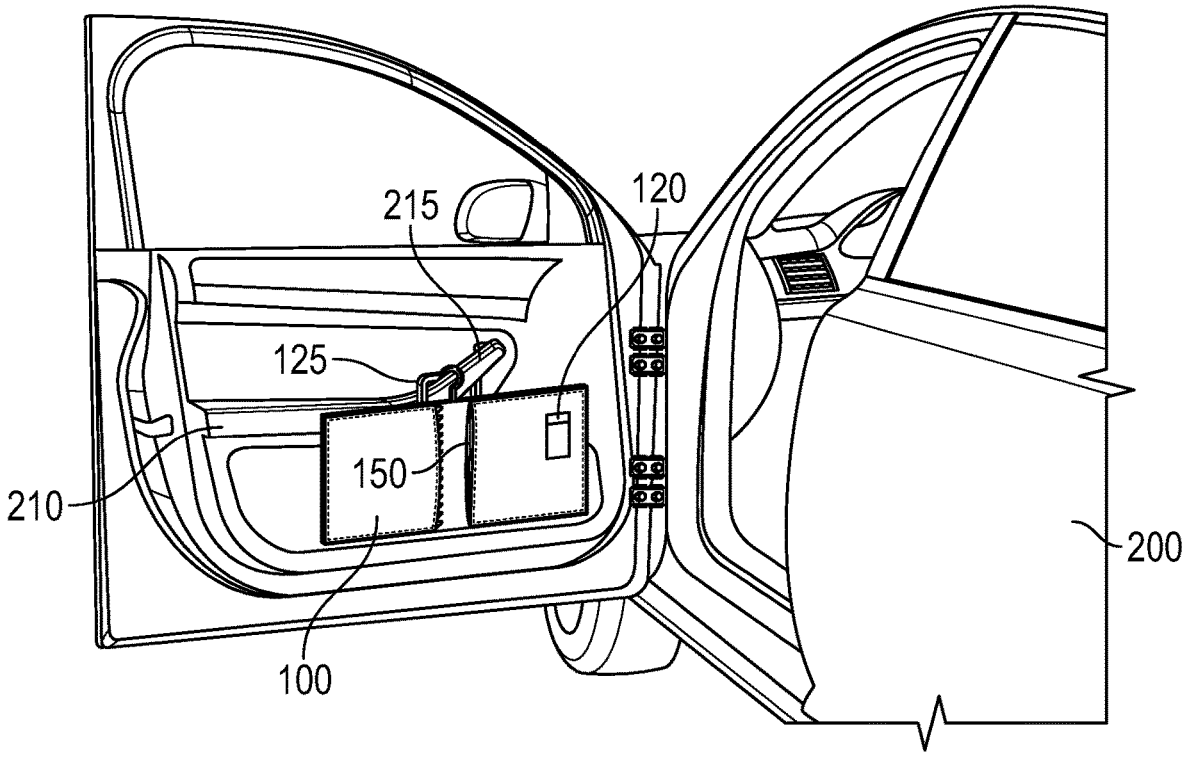
FIG. 6 illustrates the urinal apparatus 100 coupled to a door 210 of an automobile 200, in accordance with one embodiment of the present disclosure.

It should be understood that the user might use the urinal apparatus 100 at the time of travelling in an automobile. The automobile may include, but not limited to, a car, bus, truck, and so on. Referring to FIG. 6, the urinal apparatus 100 coupled to an automobile 200 is shown, in accordance with one exemplary embodiment of the present disclosure. As known, the automobile 200 comprises a door 210. Further, the door 210 may comprise a door handle 215 used to operate the door 210. The urinal apparatus 100 may be coupled to the door handle 215. Specifically, the handle 125 of the urinal apparatus 100 may be coupled to the door handle 215.

As specified above, the user may use the urinal apparatus 100 for collecting and storing urine. As such, whenever a driver or a passenger of the automobile 200 wishes to relieve of the urine, the driver may pick the bladder 150 placed in the first container 130. Further, the driver may open the cap 160 and urinate in the body 155 of the bladder 150. Upon completion, the user may place the cap 160 on the neck 158 and tighten the cap 160.

After closing the cap 160, the user may place the bladder 150 containing urine in the second container 135. The driver may use the bladders 150 for urination until he reaches a destination or the dispensing area suitable for disposing the bladders 150. After reaching, the driver may dispose off the bladders 150 containing urine.

Figure 7:
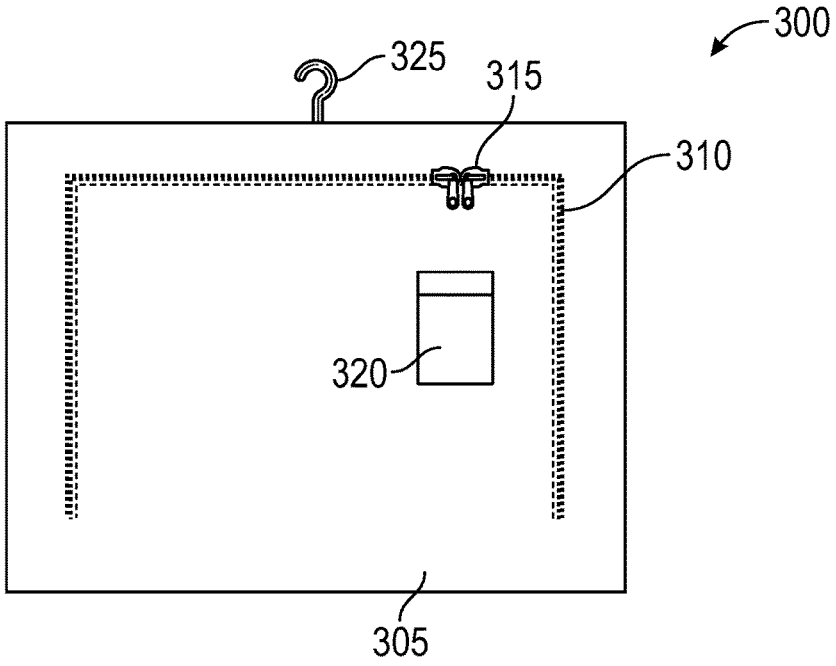
FIG. 7 illustrates a urinal apparatus 300, in accordance with another embodiment of the present disclosure.

Now referring to FIG. 7, a front view of a urinal apparatus 300 is shown, in accordance with another embodiment of the present disclosure. In the current embodiment, the urinal apparatus 100 comprises a pouch 305. The pouch 305 may be made up of plastic, fabric, polythene or any other suitable materials. It should be understood that the pouch 305 might be provided in variety of shapes such as square, rectangle, or any other shape. The pouch 305 may be used to store materials. In order to store materials, the pouch 305 may be provided with a zipper 310 that is operated using a slider assembly 315. It should be understood that the slider assembly 315 is operated slidably to access interior of the pouch 305. When accessed, the pouch 305 may be used to store bladders (as shown in FIG. 3). As specified above, the bladder may be used to collect the urine. After collecting the urine, the bladder may be placed inside the pouch 305, as explained above.

In the current embodiment, the urinal apparatus 300 may comprise a pocket 320 provided on the pouch 305. The pocket 320 might be used to store sanitizer. Furthermore, the urinal apparatus 300 comprises a handle 325 used for hanging the urinal apparatus 300.

It should be understood that the urinal apparatus explained above can be used removably coupled to the vehicle. When the user gets of the vehicle, he can remove the urinal apparatus and dispose off the bladder. Further, the user may place the urinal apparatus in the bathroom or toilet. It is obvious to a person skilled in the art to couple the urinal apparatus to any structure when travelling or when staying away from access to restrooms, and use the urinal apparatus to store the bladders in which urine is collected. After reaching desired place, the user may dispose off the bladder.

Although it is disclosed that zipper or pockets are used to store the used bladders, it is obvious to a person skilled in the art to use buttons, hooks or other known mechanisms to provide access to containers for storing used or unused bladders.

Based on the above, it is evident that the driver or passengers of the automobile might use the urinal apparatus to urinate while on the move. As they can relieve themselves while on the move, they do not have to waste time in searching for restrooms or relieve at side of the roads.

Further, with ease of access to bladder, the user of the urinal apparatus can urinate in the bladder without any discomfort. Further, the urinal apparatus can be coupled to any part of the automobile. Further, proper disposing off urine helps in preventing environment degradation.

Further, the pocket provided in the urinal apparatus allows the driver to place a sanitizer. After urinating and placing the bladder in the second container, the driver may use the sanitizer to cleanse his hands.

It should be understood that unused bladders might be placed at either of the first container or the second container. For instance, if the unused bladders are placed in the first container, then the bladder containing urine may be placed in the second container. Similarly, if the unused bladders are placed in the second container, then the bladder containing urine may be placed in the first container.

It should be understood that the shape and size of the urinal apparatus illustrated in drawings is provided for illustrative purpose only and should not construed in limited sense. A person skilled in the art will appreciate various aspects described herein with modifications.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A urinal apparatus for use in an automobile, the urinal apparatus comprising:

a base sheet having four perimeter sides, a first sheet coupled to a first end of said base sheet on three sides to form a first container having a first opening;

a second sheet coupled to a second end of said base sheet on three sides to form a second container having a second opening, said base sheet including a middle portion being a flat surface located between said first container and said second container; and a first bladder placed in the first container, said first bladder including a body having a hollow interior, said body having a top end with an extending neck portion, wherein said neck portion gives access to said hollow interior of said body, said neck portion including a cap mounted thereon, wherein first bladder is stored within said first container, said first bladder being exposed from said first opening.

2. The urinal apparatus of claim 1, wherein the first sheet further comprises a pocket.

3. The urinal apparatus of claim 1, further comprises a handle for coupling the urinal apparatus to the automobile, wherein said handle is mounted to a top perimeter side of said base sheet, said handle being a hook member extending thereout.

4. The urinal apparatus of claim 1, wherein said first sheet is sewn onto said base sheet.

5. The urinal apparatus of claim 1, wherein said second sheet is sewn onto said base sheet.

6. The urinal apparatus of claim 1, wherein said urinal apparatus includes a second bladder having a body being made of a sheet material, wherein aid body includes, a liner at a top edge configured to be torn open.

7. The urinal apparatus of claim 6, wherein said second bladder is stored within said second container.

8. A system for a urinal apparatus, comprising:

a) a vehicle having a driver side door, wherein said driver side door includes an inner portion having a door handle;

b) a base sheet having a rectangular shape with four perimeter sides, said four perimeter side including a top perimeter side, said top perimeter side having a handle mounted thereon, wherein said handle is a hook shaped member extending thereout;

c) a first sheet having a rectangular shape, said first sheet having a length that is less than a length of said base sheet, wherein said first sheet is coupled to a first end of said base sheet at the sides to form a first container with a first opening, wherein said first sheet is sewn to said base sheet, said first sheet including a pocket mounted onto an upper surface of said first sheet;

d) a second sheet having a rectangular shape, wherein said second sheet includes a length that is less than a length of said base sheet, wherein said second sheet is coupled to a second end of said base sheet at three sides to form a second container with a second opening, wherein said second sheet is sewn to said base sheet;

e) wherein said base sheet includes a middle portion separating said first sheet and said second sheet, wherein said first opening and said second opening are accessed from said middle portion;

f) a first bladder having a body, wherein said body is hollow therein, said body having a top end with a neck portion extending thereout, wherein said neck provides access to an interior of said body, said neck further including a cap being removably coupled to said body, wherein said first bladder is stored within said first container;

g) a second bladder having a body being made of a sheet material, wherein said body of said second bladder includes a liner configured to be torn open, wherein said second bladder is stored within said second container; and h) wherein said handle of said base sheet is hooked onto said door handle, said urinal apparatus located entirely within said inner portion of said door.

9. A urinal apparatus, comprising:

a) a pouch having a rectangular shape with an interior space, said pouch having a top surface, a zipper mounted said top surface of said pouch, wherein said zipper includes three perimeter sides that correspond to a top side and two side ends of said pouch, wherein said push includes a pouch mounted to said top surface, said pouch located entirely within said three perimeter sides of said zipper, said pouch further including a handle extending from said top side, wherein said handle is a hook shaped member.

* * * * *